US006930543B2

(12) United States Patent
Nishi

(10) Patent No.: US 6,930,543 B2
(45) Date of Patent: Aug. 16, 2005

(54) BIAS POTENTIAL GENERATING APPARATUS

(75) Inventor: Kazuyoshi Nishi, Kyoto (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 10/677,336

(22) Filed: Oct. 3, 2003

(65) Prior Publication Data

US 2004/0104762 A1 Jun. 3, 2004

(30) Foreign Application Priority Data

Apr. 10, 2002 (JP) ..... P2002-292325

(51) Int. Cl.[7] ..... G05F 1/10
(52) U.S. Cl. ..... 327/546; 327/543
(58) Field of Search ..... 327/530, 541, 327/543, 545, 546; 365/227–229

(56) References Cited

U.S. PATENT DOCUMENTS 5,656,946 A * 8/1997 Sim ..... 326/21
5,933,384 A * 8/1999 Terada et al. ..... 365/227
6,069,833 A * 5/2000 Koura ..... 365/226
6,107,700 A * 8/2000 Ishikawa et al. ..... 307/116
6,184,744 B1 * 2/2001 Morishita ..... 327/541
6,313,695 B1 * 11/2001 Ooishi et al. ..... 327/544
6,635,934 B2 * 10/2003 Hidaka ..... 257/369
2003/0102903 A1 * 6/2003 Cho ..... 327/544

FOREIGN PATENT DOCUMENTS

JP 01-173391 7/1989
JP 11-296245 10/1999
JP P3147079 1/2001

* cited by examiner

*Primary Examiner*—Terry D. Cunningham
(74) *Attorney, Agent, or Firm*—McDermott Will & Emery LLP

(57) ABSTRACT

A bias potential generating apparatus for generating a plurality of bias potentials by switching with a standby potential set for each bias potential is disclosed. The generated potential is restored to a bias potential from a standby potential by a potential restoration circuit. A drive control circuit controls the drive operation of the potential restoration circuit. The potential restoration circuit is provided for each bias potential. Further, the drive time of the potential restoration circuit is set arbitrarily by a drive time setting circuit.

11 Claims, 9 Drawing Sheets

BIAS POTENTIAL GENERATING APPARATUS

FIELD OF THE INVENTION

The present invention relates to a bias potential generating apparatus for generating a bias potential for a drive circuit to drive a liquid crystal panel or the like, or in particular to a bias potential generating apparatus turned off in the power save mode and rapidly restored to the operation mode from the power save mode.

BACKGROUND OF THE INVENTION

In recent years, demand has increased for building a liquid crystal panel in a portable electronic device and therefore reduced power consumption of the liquid crystal panel has been highly desired. In a liquid crystal drive apparatus for driving the liquid crystal panel, the power consumption can be effectively reduced by the power save operation in which the output circuit is stopped and the steady current is reduced to zero during the blanking period when no image is displayed. Further, in order to promote the reduction in power consumption, the power save operation is desirably performed frequently.

In performing the power save operation for the liquid crystal drive apparatus, the operation mode is required to be restored quickly from the power save mode. In the conventional liquid crystal drive apparatus, however, the bias potential cannot yet be restored at a sufficiently high rate of speed. This problem is significantly recognized in terms of the bias potential generating apparatus which is one of the circuit devices forming the liquid crystal drive apparatus.

SUMMARY OF THE INVENTION

Accordingly, the primary object of the invention is to provide a bias potential generating apparatus capable of restoring a bias potential quickly.

According to one aspect of this invention, there is provided a bias potential generating apparatus in which a plurality of potentials are generated as bias potentials, and each potential generated is switched between the bias potential and a standby potential.

According to another aspect of the invention, there is provided a bias potential generating apparatus comprising a potential restoration circuit for restoring the generated potential from the standby potential to the bias potential, and a drive control circuit for controlling the drive operation of the potential restoration circuit, wherein the potential restoration circuit is provided for each bias potential. As a result, the potential restoring operation can be performed securely for each bias potential, and the restoration time can be thereby shortened.

The drive control circuit is intended to control the drive operation of the potential restoration circuit based on a pulse waveform signal, and preferably includes an oscillation circuit for generating a clock signal for generating the pulse waveform signal. In this way, a terminal for inputting the clock signal from an external source to the bias potential generating apparatus can be eliminated.

The bias potential generating apparatus according to the invention preferably further comprises a drive time setting circuit for arbitrarily setting the drive time of the potential restoration circuit arbitrarily. Then, the drive time of the potential restoration circuit required for restoring the bias potential generating apparatus quickly, which may change with the temperature or source voltage, can be adjusted appropriately. Therefore, even in the case where the source voltage or temperature undergoes a change, all the bias potentials can be quickly restored to a just level.

A specific configuration for adjusting the drive time is described below. Specifically, the drive control circuit is used to control the drive operation of the potential restoration circuit based on a pulse waveform signal, and the drive time setting circuit includes a register for outputting a set value of the pulse waveform width of the pulse waveform signal.

The bias potential generating apparatus preferably further comprises a current setting circuit for arbitrarily setting the restoration current used for the potential restoration circuit at the time of restoring the bias potential. By doing so, the restoration current required for restoring the bias potential generating apparatus quickly can be adjusted optimally. Therefore, even in the case where the source voltage or the temperature undergoes a change, all the bias potentials can be quickly restored to a just level.

A specific configuration for adjusting the drive current is described below. Specifically, the potential restoration circuit includes a plurality of MOS transistors connected in parallel to each other for generating the restoration current, and the current setting circuit supplies a conduction control signal to each of the MOS transistors individually.

The potential restoration circuit includes a plurality of MOS transistors connected in series to each other with the gate potential and the drain potential shorted to each other for generating a threshold voltage. Preferably, the restoration voltage of the potential restoration circuit used for restoring the generated potential from the standby potential to the bias potential can be set arbitrarily by changing the number of the MOS transistors. By doing so, the restoration voltage can be set as desired. In this way, even in the case where the source voltage or the temperature undergoes a change, all the bias potentials can be quickly restored to a just level.

The bias potential generating apparatus further comprises a reference potential generating circuit preferably for generating a reference potential equal to the bias potential, wherein the potential restoration circuit is driven during the period before the generated potential reaches the reference potential, and the potential restoration circuit stops being driven when the generated potential reaches the reference potential. By doing so, all the bias potentials can be restored quickly even in the case where the source voltage or the temperature undergoes a change.

The potential restoration circuit may be configured of a restoration potential generating circuit for generating a restoration potential having the same potential as the bias potential, wherein the generated potential is shorted to the restoration potential when restoring the generated potential from the standby potential to the bias potential. By doing so, even in the case where the source voltage or the temperature undergoes a change, all the bias potentials can be quickly restored to a just level irrespective of the drive time of the potential restoration circuit at the time of restoration from off to on state.

As explained above, according to this invention, the bias potential can be quickly restored to a just level.

Also, the terminal for supplying the clock signal from an external source to the bias potential generating circuit can be eliminated.

Further, in view of the fact that the restoration current and the restoration voltage can be set at an arbitrary value, the bias potential can be restored quickly optimally in accordance with the change in capacity of the potential restoration circuit even in the case where the conditions such as the source voltage undergo a change.

BRIEF DESCRIPTION OF THE DRAWINGS

The other objects of the invention will be made apparent by understanding the specific examples described below and set forth in the appended claims. Also, many advantages of the invention not described in this specification will be recognized by those skilled in the art by embodying the invention.

DESCRIPTION OF THE PREFERRED EMBODIMENTS

The preferred embodiments of the invention are explained below with reference to the accompanying drawings.

Figure 9:
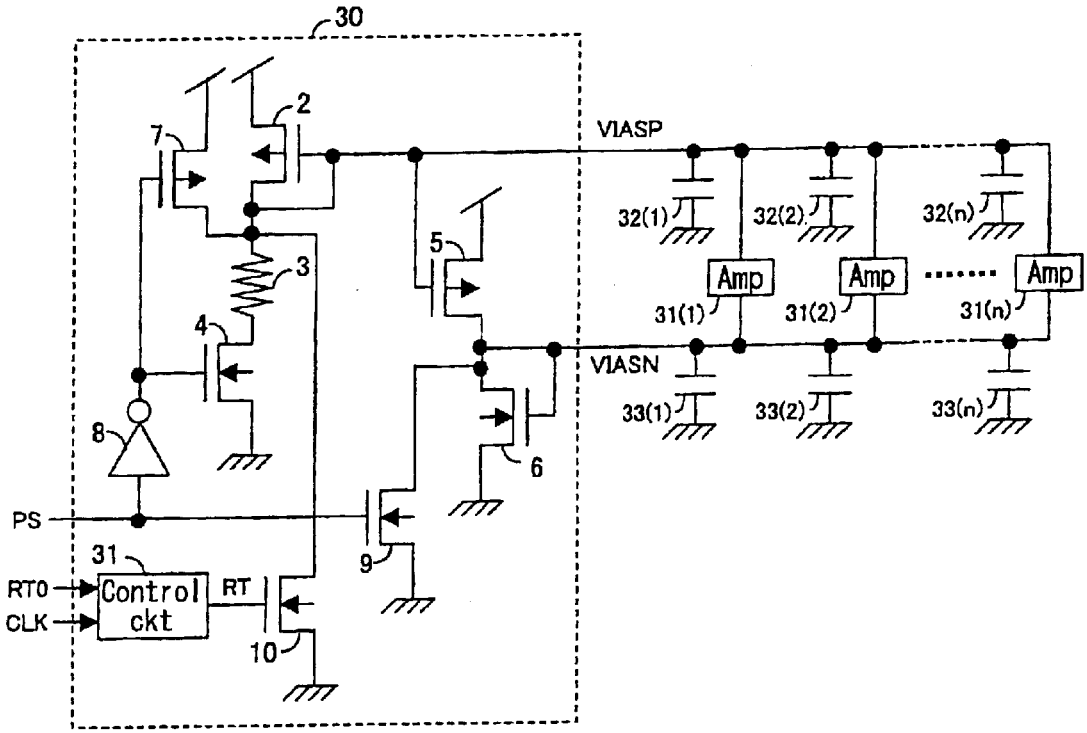
FIG. 9 is a circuit diagram showing a basic configuration of a bias potential generating apparatus embodying the invention.

First, with reference to FIG. 9, an explanation is given of a liquid crystal drive apparatus including a basic configuration of a bias potential generating apparatus according to the invention. FIG. 9 is a circuit diagram showing a liquid crystal drive apparatus comprising a drive output circuit having n outputs, combined with the bias potential generating apparatus.

The bias potential generating apparatus 30 built in the liquid crystal drive apparatus includes P-channel MOS transistors 2, 5 and 7, N-channel MOS transistors 4, 6, 9 and 10, a resistor 3, an inverter 8 and a control circuit 31. The bias potential generating apparatus 30 outputs a bias potential VIASP constituting the gate potential for the P-channel MOS transistor of a constant current source and a bias potential VIASN constituting the gate potential for the N-channel MOS transistor of a constant current source in each of liquid crystal driving amplifiers 31(1) to **31(*n*). Numerals 32(1) to 32(*n*) and 33(1) to 33(*n*)** designate the wiring capacitances.

Next, the operation performed for restoration from the power save mode in the bias potential generating apparatus having the above-mentioned configuration is explained.

First, during the drive operation of the liquid crystal, the power save signal PS is inactive (low), so that the P-channel MOS transistor 7 and the N-channel MOS transistor 9 are off, while the N-channel MOS transistor 4 is on. Also, the control circuit 31 turns a fast restoration signal RT to the inactive state (low), which signal is applied to the gate potential of the N-channel MOS transistor 10. The fast restoration signal RT is formed in a pulse wave based on a clock input CLK and an original fast restoration signal RTO. The N-channel MOS transistor 10 is turned off (inactive) by the fast restoration signal RT.

Under this condition, the P-channel MOS transistor 2, the resistor 3 and the N-channel MOS transistor 4 collaborate to generate the bias potential VIASP. In similar fashion, the P-channel MOS transistor 5 and the N-channel MOS transistor 6 collaborate to generate the bias potential VIASN. The bias potentials VIASP and VIASN are supplied to the liquid crystal driving amplifiers 31(1) to **31(*n*)**.

At the timing of transfer from the operation mode to the power save mode, the power save signal PS becomes active (high). Then, the P-channel MOS transistor 7 and the N-channel MOS transistor 9 turn on, while the N-channel MOS transistor 4 turns off. As a result, the bias potential VIASP turns high, the P-channel MOS transistor 5 turns off, and the bias potential VIASN turns low. The steady current in the bias potential generating apparatus 30 is reduced to zero, and thus the bias potential generating apparatus 30 enters the power save mode.

On the other hand, at the timing of transfer from the power save mode to the operation mode, the power save signal PS turns inactive (low). Then, the P-channel MOS transistor 7 and the N-channel MOS transistor 9 turn off, while the N-channel MOS transistor 4 turns on. As a result, the P-channel MOS transistor 2, the resistor 3 and the N-channel MOS transistor 4 cause the tendency of the bias potential VIASP returning to a predetermined bias potential level. For the bias potential VIASP to return to the predetermined bias potential, however, the input capacitances of the amplifiers 31(1) to **31(*n*) and the wiring capacitances 32(1) to 32(*n*)** are required to be discharged. This discharge operation takes a considerable length of time. Therefore, unless some measures are taken, the restoration of the bias potential VIASP requires a considerable length of time.

In view of this, the control circuit 31 turns the fast restoration signal RT to active (high) state and supplies the resulting signal to the gate potential of the N-channel MOS transistor 10. Thus, the N-channel MOS transistor 10 is kept on for a predetermined length of time. As a result, the bias potential VIASP is pulled toward the ground potential and returns to a predetermined bias potential quickly.

The successful restoration of the bias potential VIASP causes the restoration of the bias potential VIASN to a predetermined bias potential level by the P-channel MOS transistor 5 and the N-channel MOS transistor 6, thereby completing the restoring operation.

Nevertheless, the speed of the aforementioned operation of restoring the bias potential of the bias potential generating apparatus 30 is not sufficiently high for the reason described below.

In the bias potential generating apparatus 30, the bias potential VIASP is restored quickly by the operation of the N-channel MOS transistor 10, whereas the bias potential VIASN is restored with a minuscule current due to the P-channel MOS transistor 5 and the N-channel MOS transistor 6. As a result, considerable time is required for charging the input capacitances of the amplifiers 31(1) to 31(*n*) and the wiring capacitances 33(1) to 33(*n*), thereby posing a stumbling block to the fast restoration of the bias potential VIASN.

Also, the bias potential generating apparatus 30 requires optimum adjustment of the fast restoration signal RT in accordance with the change in temperature and source voltage. Otherwise, the bias potential VIASP would be pulled excessively or insufficiently toward the ground potential or the current consumption would be increased or the restoration time delayed. On the other hand, the signal form (such as the pulse width) of the fast restoration signal RT required for fast restoration of the bias potential generating apparatus 30 has the feature of changing with the temperature and the source voltage. Therefore, for restoring the bias potential VIASP quickly, the apparatus is required to be designed by setting the fast restoration signal RT in an optimum signal form for a given condition. In the bias potential generating apparatus 30, however, the fast restoration signal RT cannot be adjusted to an optimum signal form for fast restoration.

This inconvenience of the bias potential generating apparatus 30 is obviated by each embodiment of the invention described below.

(First Preferred Embodiment)

Figure 1:
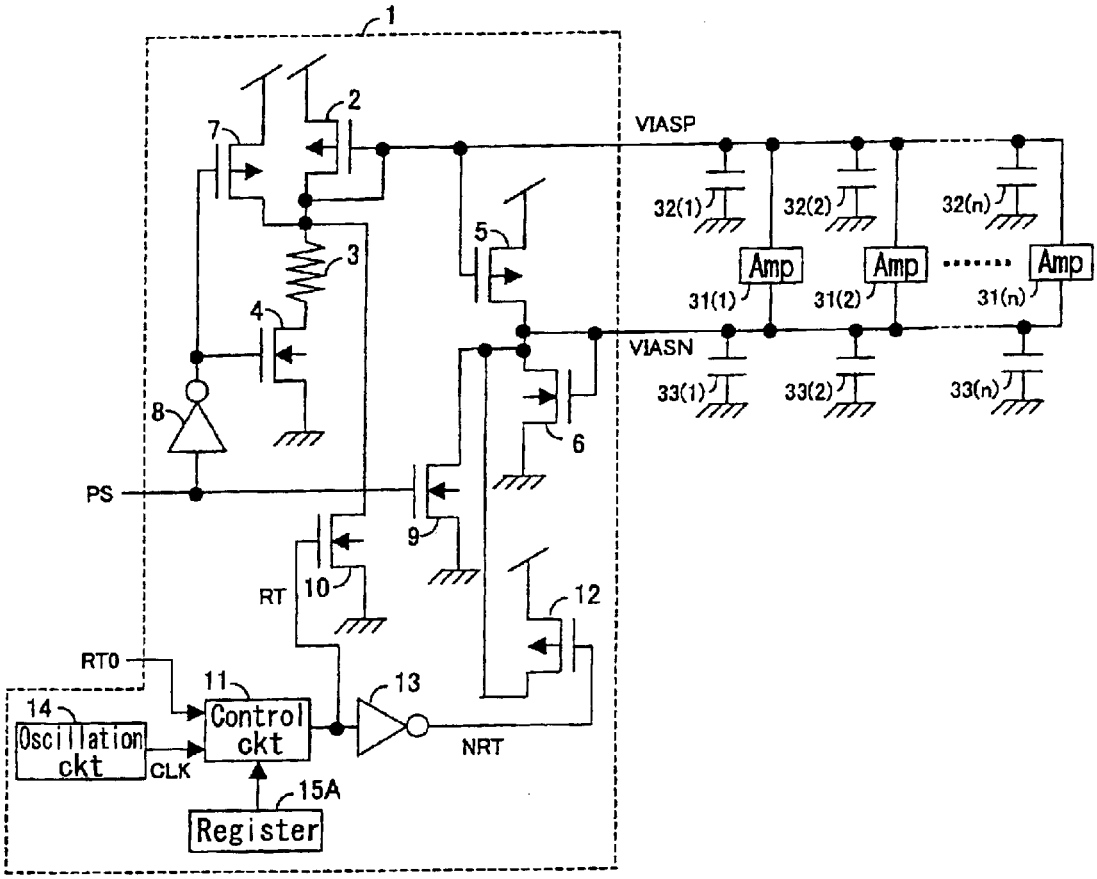
FIG. 1 is a circuit diagram showing a configuration of a bias potential generating apparatus according to a first preferred embodiment of the invention.

FIG. 1 shows a liquid crystal drive apparatus having comprising a built-in bias potential generating apparatus according to a first preferred embodiment of the invention. According to this embodiment, the invention is explained with reference to a liquid crystal drive apparatus comprising a bias potential generating apparatus combined with a drive output circuit having n liquid crystal drive outputs.

In FIG. 1, reference numeral 1 designates a bias potential generating apparatus. The bias potential generating apparatus 1 comprises P-channel MOS transistors 2, 5, 7 and 12, N-channel MOS transistors 4, 6, 9 and 10, a resistor 3, inverters 8 and 13, a control circuit 11, an oscillation circuit 14 and a register 15A. The bias potential generating apparatus 1 outputs bias potentials VIASP and VIASN. The bias potential VIASP constitutes the gate potential for the P-channel MOS transistor of a constant current source in each of amplifiers 31(1) to 31(*n*) for driving the liquid crystal. The bias potential VIASN constitutes the gate potential for the N-channel MOS transistor of a constant current source. Numerals 32(1) to 32(*n*) and 33(1) to 33(*n*) designate the wiring capacitances.

The control circuit 11 outputs a fast restoration signal RT in pulse waveform based on the clock input CLK output from the oscillation circuit 14. The control circuit 11 adjusts the pulse width of the fast restoration signal RT based on the set value output from the register 15A.

Next, the operation of restoring the bias potential generating apparatus 1 configured as set forth above, from the power save mode, is explained.

First, during the operation of driving the liquid crystal, the power save signal PS is inactive (low). Therefore, the P-channel MOS transistor 7 and the N-channel MOS transistor 9 are in the off state, while the N-channel MOS transistor 4 is in the on state. Also, the N-channel MOS transistor 10 is in the off state since the fast restoration signal RT constituting an output signal of the control circuit 11 is inactive (low). In similar fashion, since the fast restoration signal NRT is active (high), the P-channel MOS transistor 12 is in the off state. The fast restoration signal NRT is generated as the result of inversion of the fast restoration signal RT by the inverter 13.

In the process, the bias potential VIASP is generated by the collaboration of the P-channel MOS transistor 2, the resistor 3 and the N-channel MOS transistor 4. In similar fashion, the bias potential VIASN is generated by the collaboration of the P-channel MOS transistor 5 and the N-channel MOS transistor 6. These bias potentials VIASP and VIASN are supplied to the liquid crystal driving amplifiers 31(1) to 31(*n*).

Next, at the timing of transfer from the operation mode to the power save mode, the power save signal PS becomes active (high). Then, the P-channel MOS transistor 7 and the N-channel MOS transistor 9 turn on, while the N-channel MOS transistor 4 turns off. As a result, the bias potential VIASP turns high (standby potential), and the P-channel MOS transistor 5 turns off, thereby turning the bias potential VIASN to the low state (standby potential). In this way, the bias potentials VIASP and VIASN transfer to the standby potential, and therefore the steady current in the bias potential generating apparatus 1 becomes zero, thereby setting the bias potential generating apparatus 1 in power save mode.

At the next timing of transfer from the power save mode to the operation mode, the power save signal PS becomes inactive (low). Then, the P-channel MOS transistor 7 and the N-channel MOS transistor 9 turn off, while the N-channel MOS transistor 4 turns on. As a result, the collaboration of the P-channel MOS transistor 2, the resistor 3 and the N-channel MOS transistor 4 causes the tendency of the bias potential VIASP to return to a predetermined bias potential.

However, the return of the bias potential VIASP to a predetermined bias potential level, requires the discharge of the input capacitances of the amplifiers 31(1) to 31(*n*) and the wiring capacitances 32(1) to 32(*n*). This process requires some length of time. Therefore, the restoration of the bias potential VIASP would also require some length of time unless some counter measures are taken.

Figure 2:
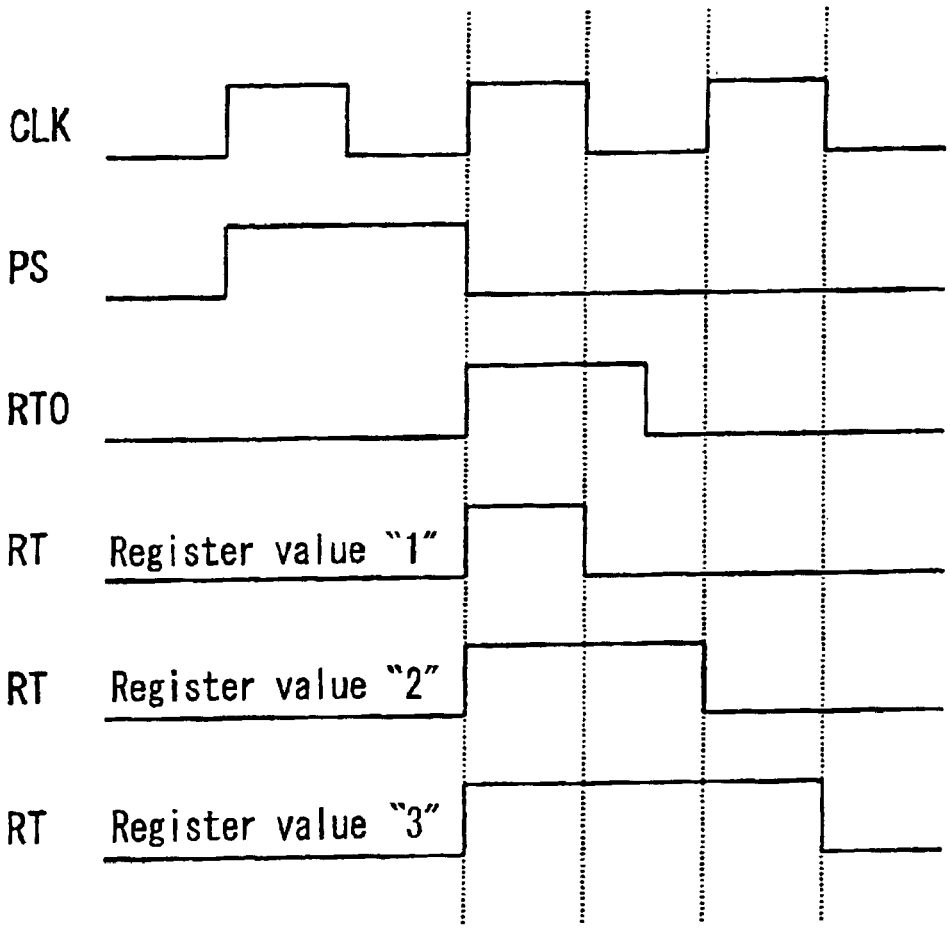
FIG. 2 is a time chart showing the operation of a bias potential generating apparatus according to the first preferred embodiment of the invention.

In view of this, the control circuit 11 sets the fast restoration signal RT in pulse waveform to the active (high) state based on the clock input CLK supplied from the oscillation circuit 14 and the original fast restoration signal RTO supplied from an external source to the apparatus. The control circuit 11 sets the pulse width (active period) of the fast restoration signal RT in accordance with the set value of the register 15A as shown in FIG. 2. In the case shown in FIG. 2, assume that the set value of the register 15A is 1. The pulse width (active period) of the fast restoration signal RT is set to the width of one pulse of the clock input CLK. In the case where the set value is 2, on the other hand, the pulse width (active period) of the fast restoration signal RT is set to a value equal to two pulses of the clock input CLK. In the case where the set value is 3, the pulse width (active period) of the fast restoration signal RT is set to a value equal to the width of three pulses of the clock input CLK.

As a result, the set value of the register 15A is changed, and the pulse width (active period) of the fast restoration signal RT is set arbitrarily.

The fast restoration signal RT that has thus become active (high) is applied to the gate potential for the N-channel MOS transistor 10 and thereby turns on the transistor 10 for a predetermined length of time. Consequently, the bias potential VIASP is pulled toward the ground potential, and thus restored to a predetermined bias potential level quickly.

As the result of inverting the fast restoration signal RT by the inverter 13, the fast restoration signal NRT becomes inactive (low). The fast restoration signal NRT that has thus become inactive is applied to the gate potential of the P-channel MOS transistor 12, which is thus kept on for a predetermined length of time. As a result, the bias potential VIASN is pulled toward the power supply and therefore restored quickly to a predetermined potential.

According to this embodiment, the bias potential VIASP is restored to a predetermined potential level by the operation of the N-channel MOS transistor 10, and the bias potential VIASN is restored to a predetermined potential level by the operation of the P-channel MOS transistor 12. In this way, the provision of the MOS transistors 10 and 12 for restoration corresponding to each bias potential in the bias potential generating apparatus 1 shortens the restoration time.

In the bias potential generating apparatus 1, the pulse width of each of the fast restoration signals RT and NRT can be changed in accordance with the set value of the register 15A. Therefore, by changing the set value of the register 15A in accordance with the change of conditions such as the source voltage, an optimum pulse width can be selected. As a result, the drive time for the MOS transistors 10 and 12 required for fast restoration of the bias potential generating apparatus 1 can be set in accordance with the change, if any, of the temperature or the source voltage. As a result, even in the case where the temperature or the source voltage undergoes a change, the bias potentials VIASP and VIASN can be quickly restored to a just level.

According to this embodiment, the P-channel MOS transistor 12 and the N-channel MOS transistor 10 make up a potential restoration circuit. The oscillation circuit 14, the control circuit 11 and the inverter 13 make up a drive control circuit. Also, the register 15A makes up a drive time setting circuit.

The N-channel MOS transistor 10 and the P-channel MOS transistor 12 according to this embodiment may be replaced, with equal effect, by a CMOS transfer gate including an N-channel MOS transistor and a P-channel MOS transistor connected in parallel to each other.

(Second Preferred Embodiment)

Figure 3:
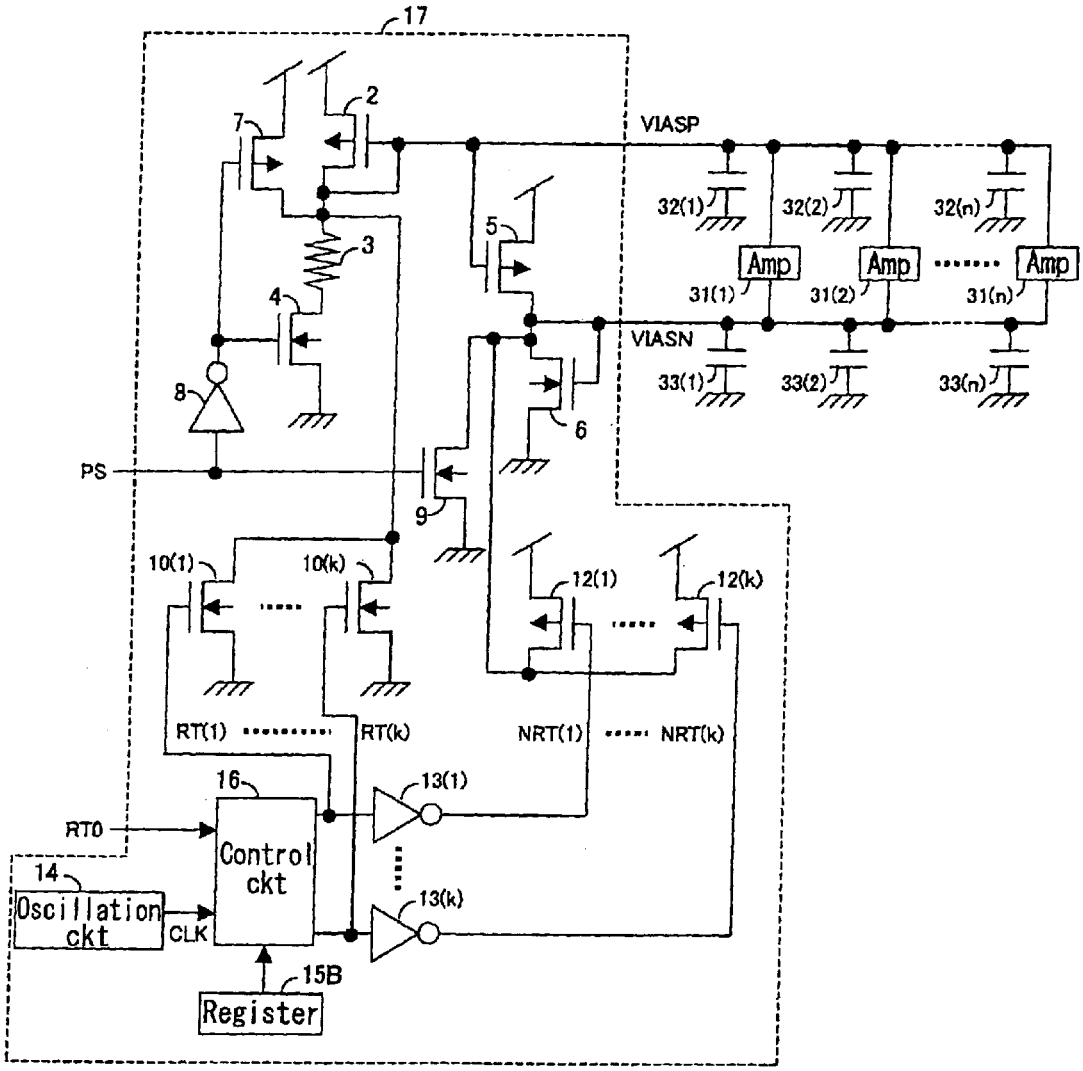
FIG. 3 is a circuit diagram showing a configuration of a bias potential generating apparatus according to a second preferred embodiment of the invention.

FIG. 3 is a circuit diagram showing a liquid crystal driving apparatus including a bias potential generating apparatus according to a second preferred embodiment of the invention. According to this embodiment, the invention is explained with reference to a liquid crystal driving apparatus comprising a bias potential generating apparatus combined with a drive output circuit having n liquid crystal driving outputs.

In FIG. 3, numeral 17 designates a bias potential generating apparatus. The bias potential generating apparatus 17 comprises P-channel MOS transistors 2, 5, 7 and 12(1) to 12(*k*), N-channel MOS transistors 4, 6, 9 and 10(1) to 10(*k*), a resistor 3, inverters 8 and 13(1) to 13(*k*), a control circuit 16, an oscillation circuit 14 and a register 15B. The bias potential generating apparatus 17 outputs a bias potential VIASP constituting the gate potential for the P-channel MOS transistor of a constant current source and a bias potential VIASN constituting the gate potential for the N-channel MOS transistor of the constant current source in each of the liquid crystal driving amplifiers 31(1) to 31(*n*). Numerals 32(1) to 32(*n*) and 33(1) to 33(*n*) designate the wiring capacitances.

The control circuit 16 outputs a fast restoration signal RT in pulse waveform based on a clock input CLK output from the oscillation circuit 14. The control circuit 11 adjusts the number of those to be turned to active state among the fast restoration signals RT(1) to RT(k), based on the set value output from the register 15B.

The operation of restoring the bias potential generating apparatus 17 having the above-mentioned configuration from the power save mode is explained below.

During the operation of driving the liquid crystal, the power save signal PS is inactive (low). Therefore, the P-channel MOS transistor 7 and the N-channel MOS transistor 9 are off, while the N-channel MOS transistor 4 is on. Also, since the fast restoration signals RT(1) to RT(k) making up output signals of the control circuit 16 are inactive (low), the N-channel MOS transistors 10(1) to 10(*k*) are in the off state. In a similar manner, the P-channel MOS transistors 12(1) to 12(*k*) are off since the fast restoration signals NRT(1) to NRT(k) are active (high). The fast restoration signals NRT(1) to NRT(k) are generated as the result of inverting the fast restoration signals RT(1) to RT(k) by the inverters 13(1) to 13(*k*), respectively.

At the same time, the P-channel MOS transistor 2, the resistor 3 and the N-channel MOS transistor 4 collaborate to generate the bias potential VIASP. In similar fashion, the P-channel MOS transistor 5 and the N-channel MOS transistor 6 collaborate to generate the bias potential VIASN. The bias potentials VIASP and VIASN are supplied to the liquid crystal driving amplifiers 31(1) to 31(*n*).

Next, with the arrival of the timing of transfer from the operation mode to the power save mode, the power save signal SP becomes active (high). Then, the P-channel MOS transistor 7 and the N-channel MOS transistor 9 turn on, while the N-channel MOS transistor 4 turns off. As a result, the bias potential VIASP becomes high (standby potential), the P-channel MOS transistor 5 turns off, and the bias potential VIASN turns low (standby potential). In this way, the bias potentials VIASP and VIASN transfer to a standby potential, and therefore the bias potential generating apparatus 17, with the steady current in the circuits thereof reduced to zero, turns into the power save mode.

At the next timing of transfer from power save mode to operation mode, the power save signal PS becomes inactive (low). Then, the P-channel MOS transistor 7 and the N-channel MOS transistor 9 turn off, while the N-channel MOS transistor 4 turns on. As a result, the P-channel MOS transistor 2, the resistor 3 and the N-channel MOS transistor 4 collaborate to cause the tendency of the bias potential VIASP to return to a predetermined bias potential level. When the bias potential VIASP returns to the predetermined bias potential level, however, the input capacitances of the amplifiers 31(1) to 31(*n*) and the wiring capacitances 32(1) to 32(*n*) are required to be discharged, which consumes a considerable length of time. Therefore, unless some measures are taken, the restoration of the bias potential VIASP takes some length of time.

Figure 4:
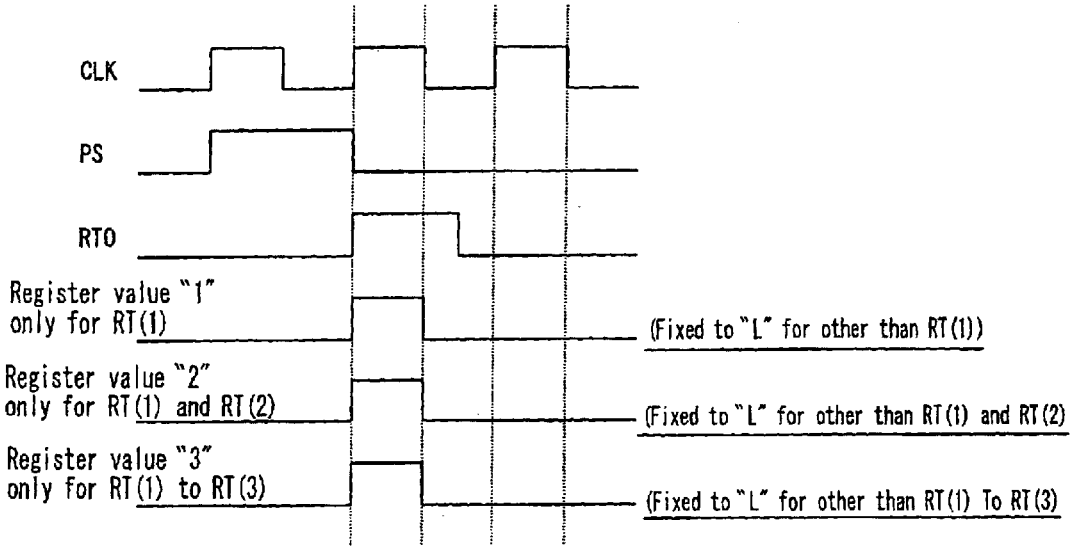
FIG. 4 is a time chart showing the operation of a bias potential generating apparatus according to the second preferred embodiment of the invention.

In view of this, the control circuit 16 turns the fast restoration signals RT(1) to RT(k) in pulse waveform to active (high) state based on the clock input CLK supplied from the oscillation circuit 14 and the original fast restoration signal RTO supplied from an external source to the apparatus. The control circuit 16, as shown in FIG. 4, sets the number of those to be turned to active state of the fast restoration signals RT(1) to RT(k), in accordance with the set value of the register 15B. In the case shown in FIG. 4, assume that the set value of the register 15B is 1. The control circuit 16 turns only the fast restoration signal RT(1) to active (high) state, while the remaining fast restoration signals RT(2) to RT(k) are turned to inactive (low) state. In similar fashion, in the case where the set value of the register 15B is 2, the control circuit 16 turns only the fast restoration signals RT(1) and RT(2) to active (high) state, and the remaining fast restoration signals RT(3) to RT(k) to inactive (low) state. Further, in the case where the set value of the register 15B is 3, the control circuit 16 turns only the fast restoration signals RT(1) to RT(3) to active (high) state, and the remaining fast restoration signals RT(4) to RT(k) to inactive (low) state.

By changing the set value of the register 15B in this manner, the number of those to be turned to active state among the fast restoration signals RT(1) to RT(k) can be set arbitrarily.

Those that have turned to active state among the fast restoration signals RT(1) to RT(k) are applied to the gate potential of the corresponding ones of the N-channel MOS transistors 10(1) to 10(*k*), respectively, so that only the particular ones of the transistors 10(1) to 10(*k*) are selectively kept on for a predetermined time length. As a result, the bias potential VIASP is pulled toward the ground potential and thereby restored to a predetermined value quickly.

The inversion of the fast restoration signals RT(1) to RT(k) through the inverters 13(1) to 13(*k*) turns the fast restoration signals NRT(1) to NRT(k), respectively, to inactive (low) state. The fast restoration signals NRT(1) to NRT(k) thus turned to inactive state are applied to the gate potential of the P-channel MOS transistors 12(1) to 12(*k*) and thus turn on the transistors 12(1) to 12(*k*) for a certain length of time. As a result, the bias potential VIASN is pulled toward the power supply side and thereby restored to a predetermined level quickly.

According to this embodiment, the bias potential VIASP is restored to a predetermined bias potential level by the operation of the N-channel MOS transistors 10(1) to 10(*k*), and so are the bias potential VIASN by the operation of the P-channel MOS transistors 12(1) to 12(*k*). This provision of the MOS transistors 10(1) to 10(*k*) and 12(1) to 12(*k*) for restoration corresponding the respective bias potentials shortens the time required for restoration.

In the bias potential generating apparatus 17, the number of those to be turned to active state among the fast restoration signals RT(1) to RT(k) and NRT(1) to NRT(k) can be changed in accordance with the set value of the register 15B. Therefore, by changing the set value of the register 15B in accordance with the change in the conditions such as the source voltage, an optimum number of the fast restoration signals RT(1) to RT(k) and NRT(1) to NRT(k) to be turned to active state can be selected.

By adjusting the number of the fast restoration signals RT(1) to RT(k) and NRT(1) to NRT(k) to be turned to active state, the number of those to be turned on among the P-channel MOS transistors 12(1) to 12(*k*) and the N-channel MOS transistors 10(1) to 10(*k*) can be adjusted. Further, the drive current of the bias potential generating apparatus 17 can be adjusted by adjusting the number of those to be turned to active state among the P-channel MOS transistors 12(1) to 12(*k*) and the N-channel MOS transistors 10(1) to 10(*k*).

As a result, the output current of the MOS transistors 10 and 12 required for quickly restoring the bias potential generating apparatus 17, which may undergo a change with temperature or source voltage, can be set in accordance with the particular change. As a result, even in the case where the source voltage or the temperature undergoes a change, the bias potentials VIASP and VIASN can be quickly restored to a just level.

According to this embodiment, a potential restoration circuit includes the P-channel MOS transistors 10(1) to 10(*k*) and the N-channel MOS transistors 12(1) to 12(*k*), a drive control circuit including the oscillation circuit 14, the control circuit 16 and the inverters 13(1) to 13(*k*), and a current setting circuit includes the register 15B.

The N-channel MOS transistors 10(1) to 10(*k*) and the P-channel MOS transistors 12(1) to 12(*k*) according to this embodiment may be replaced, with equal effect, by a CMOS transfer gate including an N-channel MOS transistor and a P-channel MOS transistor connected in parallel to each other.

(Third Preferred Embodiment)

Figure 5:
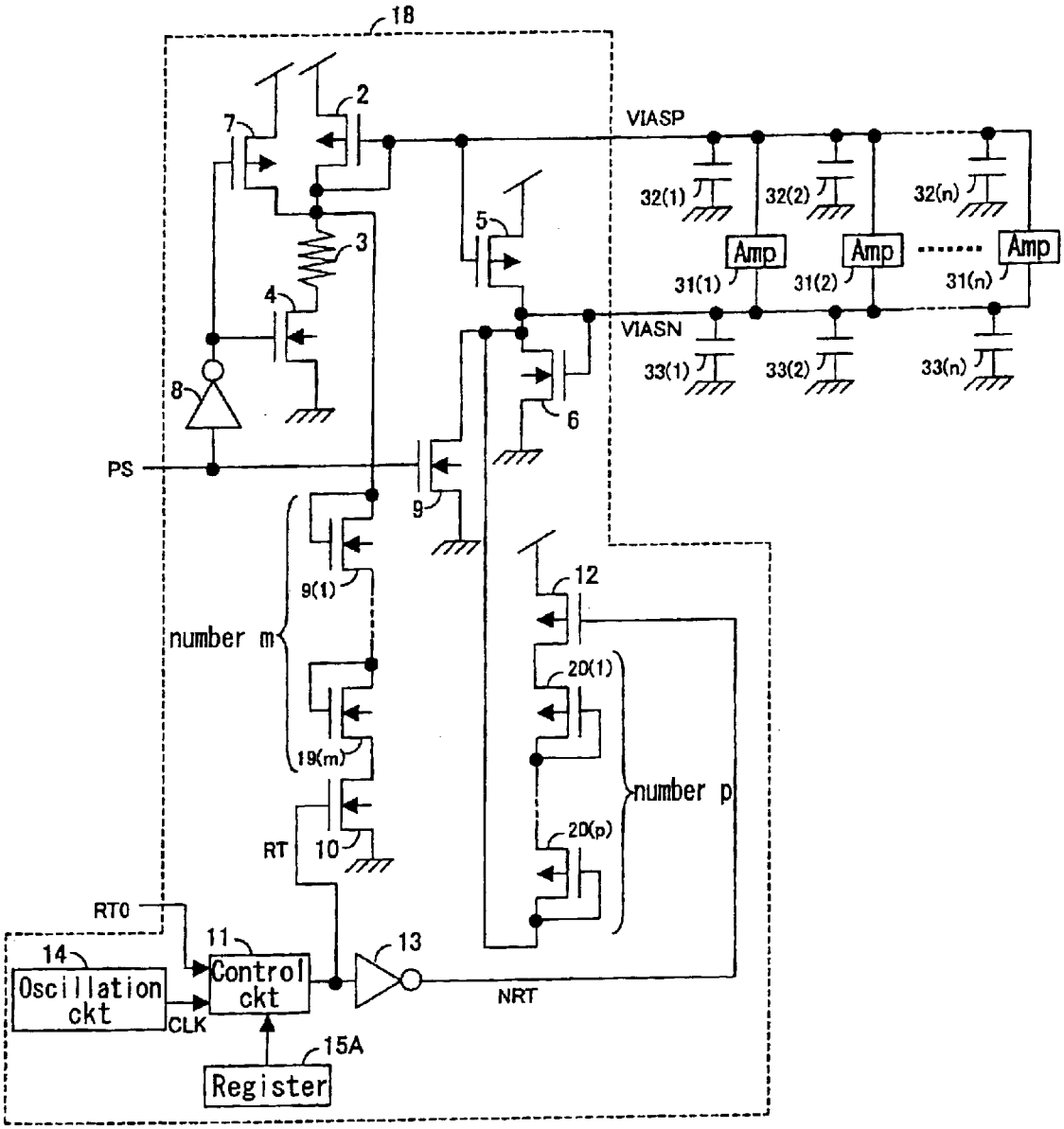
FIG. 5 is a circuit diagram showing a configuration of a bias potential generating apparatus according to a third preferred embodiment of the invention.

FIG. 5 is a circuit diagram showing a liquid crystal driving apparatus comprising a built-in bias potential generating apparatus according to a third preferred embodiment of the invention. According to this embodiment, the invention is explained with reference to a liquid crystal driving apparatus including a drive output unit having n liquid crystal drive outputs and a bias potential generating apparatus combined with each other.

In FIG. 5, numeral 18 designates a bias potential generating apparatus. The bias potential generating apparatus 18 includes P-channel MOS transistors 2, 5, 7, 12 and 20(1) to 20(*p*), N-channel MOS transistors 4, 6, 9, 10 and 19(1) to 19(*m*), a resistor 3, inverters 8 and 13, a control circuit 11, an oscillation circuit 14 and a register 15A. The bias potential generating apparatus 18 outputs a bias potential VIASP constituting the gate potential of the P-channel MOS transistor of the constant current source and a bias potential VIASN constituting the gate potential for the N-channel MOS transistor of the constant current source in the amplifiers 31(1) to 31(*n*) for driving the liquid crystal. Numerals 32(1) to 32(*n*) and 33(1) to 33(*n*) designate the wiring capacitances.

The N-channel MOS transistors 19(1) to 19(*m*) have the gate potential and the drain potential thereof shorted to each other. Therefore, in the N-channel MOS transistors 19(1) to 19(*m*), a threshold voltage VTN is generated between the drain potential and the source potential. The N-channel MOS transistors 19(1) to 19(*m*) are connected in series to each other, and the number m of the transistors 19(1) to 19(*m*) is determined in such a manner as to hold the relation that the ground potential plus the product of the threshold voltage VTN and m is not larger than a predetermined value of the bias potential VIASP.

In similar fashion, the P-channel MOS transistors 20(1) to 20(*p*) have the gate potential and the drain potential thereof shorted to each other. Therefore, in the P-channel MOS transistors 20(1) to 20(*p*), a threshold voltage VTP for the P-channel MOS transistor is generated between the source potential and the drain potential. The P-channel MOS transistors 20(1) to 20(*p*) are connected in series to each other, and the number p is determined in such a manner as to hold the relation that the source potential less the product of the absolute value of the threshold voltage VTP and p is not smaller than a predetermined value of the bias potential VIASN.

Next, the restoring operation of the bias potential generating apparatus 18 having the aforementioned configuration from the power save mode is explained.

First, during the operation for driving the liquid crystal, the power save signal PS is inactive (low), and therefore the P-channel MOS transistor 7 and the N-channel MOS transistor 9 are off, while the N-channel MOS transistor 4 is on. On the other hand, since the fast restoration signal RT output from the control circuit 11 is inactive (low), the N-channel MOS transistor 10 is in the off state. In a similar manner, since the fast restoration signal NRT is active (high), the P-channel MOS transistor 12 is off. The fast restoration signal NRT is generated by inverting the fast restoration signal RT through the inverter 13.

In the process, the P-channel MOS transistor 2, the resistor 3 and the N-channel MOS transistor 4 collaborate to generate a bias potential VIASP. In a similar manner, the P-channel MOS transistor 5 and the N-channel MOS transistor 6 collaborate to generate a bias potential VIASN. The bias potentials VIASP and VIASN are supplied to the liquid crystal driving amplifiers 31(1) to 31(*n*).

Next, with the arrival of the timing for transfer from the operation to the power save mode, the power save signal PS turns to active (high) state. Then, the P-channel MOS transistor 7 and the N-channel MOS transistor 9 turn on, while the N-channel MOS transistor 4 turns off. As a result, the bias potential VIASP turns high (standby potential), and the P-channel MOS transistor 5 turns off thereby to turn the bias potential VIASN to a low (standby) level. As the result of transfer of the bias potentials VIASP and VIASN to the standby level, the steady current in the bias potential generating apparatus 18 is reduced to zero, and therefore the bias potential generating apparatus 18 enters the power save mode.

With the arrival of the timing for transfer from the power save mode to the operation mode, the power save signal PS turns to inactive (low) state. The P-channel MOS transistor 7 and the N-channel MOS transistor 9 turn off, while the N-channel MOS transistor 4 turns on. As a result, the P-channel MOS transistor 2, the resistor 3 and the N-channel MOS transistor 4 collaborate to cause the tendency of the bias potential VIASP to return to a predetermined bias potential level. However, when the bias potential VIASP returns to the predetermined bias potential level, the input capacitances of the amplifiers 31(1) to **31(*n*) and the wiring capacitances 32(1) to 32(*n*)** are required to be discharged, thereby consuming a considerable time. Therefore, unless some measures are taken, the restoration of the bias potential VIASP would require considerable time.

In view of this, the control circuit 11 turns the fast restoration signal RT in pulse waveform to active (high) state based on the clock input CLK supplied from the oscillation circuit 14 and the original fast restoration signal RT0 supplied from an external source to the apparatus. The control circuit 11 sets the pulse width of the fast restoration signal RT in accordance with the set value of the register 15A. Therefore, by changing the set value of the register 15A, the pulse width of the fast restoration signal RT can be set arbitrarily.

The fast restoration signal RT that has turned to active state is applied to the gate potential of the N-channel MOS transistor 10, and keeps the transistor 10 in on state for a certain period of time. As a result, the bias potential VIASP is pulled toward the ground potential, and therefore is rapidly restored to a predetermined bias potential level.

The inversion of the fast restoration signal RT by the inverter 13, on the other hand, turns the fast restoration signal NRT to inactive (low) state. The fast restoration signal NRT that has turned to inactive state (low) is applied to the gate potential of the P-channel MOS transistor 12 and keeps the transistor 12 in on state for a predetermined length of time. As a result, the bias potential VIASN is pulled toward the power supply, and therefore is rapidly restored to a predetermined bias potential level.

According to this embodiment, the bias potential VIASP is restored to a predetermined potential level by the operation of the N-channel MOS transistor 10, while the bias potential VIASN is restored to a predetermined bias potential level by the operation of the P-channel MOS transistor 12. In this way, the provision of the MOS transistors 10 and 12 for restoring corresponding to the respective bias potentials shortens the time required for restoration.

The bias potential generating apparatus 18 can change the pulse width of the fast restoration signals RT and NRT in accordance with the set value of the register 15A. Therefore, by changing the set value of the register 15A in accordance with the change in conditions such as the source voltage, an optimum pulse width can be selected. As a result, the drive time of the MOS transistors 10 and 12 required for fast restoration of the bias potential generating apparatus 18 can be set to an appropriate value corresponding to a change, if any, of the temperature or the source voltage. Thus, even in the case where the temperature or the source voltage undergoes a change, the bias potentials VIASP and VIASN can be quickly restored to a just level.

Further, the N-channel MOS transistors 19(1) to **19(*m*) are connected in series with each other, and so are the P-channel MOS transistors 20(1) to 20(*p*)**. The numbers m and p of the transistors are determined in such a manner as to hold the relations, respectively, that the ground potential plus the product of the threshold voltage VTN and m is not larger than a predetermined potential level of the bias potential VIASP, and that the source potential less the product of the absolute value of the threshold voltage VTP and p is not smaller than a predetermined potential level of the bias potential VIASN. Therefore, by setting the numbers m and p of the transistors arbitrarily, the restoration voltage used for restoring the bias potential (generated potential) from the standby potential to a predetermined potential level can be set arbitrarily. Therefore, even in the case where the source voltage or the temperature undergoes a change, all the bias potentials can be quickly restored to a just level.

According to this embodiment, the N-channel MOS transistors 10 and 19(1) to **19(*m*) and the P-channel MOS transistors 12 and 20(1) to 20(*p*) make up a potential restoration circuit. The oscillation circuit 14, the control circuit 11 and the inverter 13 make up a drive control circuit. Also, the register 15**A makes up a drive time setting circuit.

The N-channel MOS transistor 10 and the P-channel MOS transistor 12 according to this embodiment may be replaced, with equal effect, by a CMOS transfer gate including an N-channel MOS transistor and a P-channel MOS transistor connected in parallel to each other.

(Fourth Preferred Embodiment)

Figure 6:
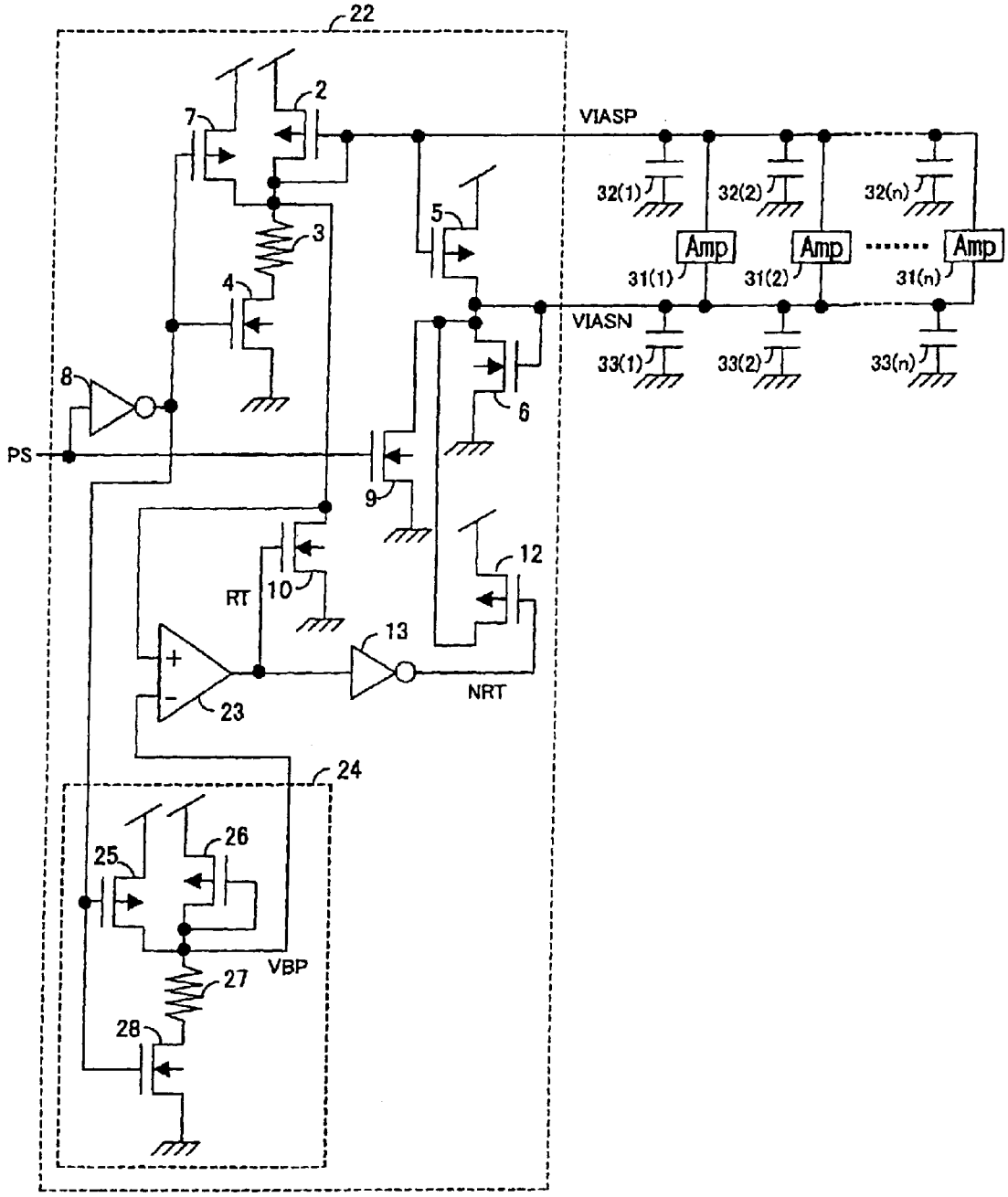
FIG. 6 is a circuit diagram showing a configuration of a bias potential generating apparatus according to a fourth preferred embodiment of the invention.

FIG. 6 is a circuit diagram showing a liquid crystal driving apparatus including a bias potential generating apparatus according to a fourth preferred embodiment of the invention. According to this embodiment, the invention is described with reference to a liquid crystal driving apparatus comprising a drive output unit having n liquid crystal drive outputs and a bias potential generating apparatus combined with each other.

In FIG. 6, numeral 22 designates a bias potential generating apparatus. The bias potential generating apparatus 22 includes P-channel MOS transistors 2, 5, 7 and 12, N-channel MOS transistors 4, 6, 9 and 10, a resistor 3, inverters 8 and 13, a comparator 23 and a reference potential generating circuit 24. The bias potential generating apparatus 22 outputs a bias potential VIASP making up the gate potential for the P-channel MOS transistor of a constant current source and a bias potential VIASN making up the gate potential for the N-channel MOS transistor of a constant current source in the liquid crystal driving amplifiers 31(1) to **31(*n*). Numerals 32(1) to 32(*n*) and 33(1) to 33(*n*)** designate the wiring capacitances.

The reference potential generating circuit 24 includes P-channel MOS transistors 25 and 26, an N-channel MOS transistor 28 and a resistor 27. The reference potential generating circuit 24 generates a reference potential VBP not smaller than the bias potential VIASP in steady state of operation.

The comparator 23 compares the positive input potential with the negative input potential. The comparator 23 turns on the N-channel MOS transistor 10 in the case where the positive input potential is higher than the negative input potential, and turns off the N-channel MOS transistor 10 in the case where the positive input potential is equal to or lower than the negative input potential.

Next, the operation of restoring the bias potential generating apparatus 22 having the aforementioned configuration from the power save mode is explained.

First, during the liquid crystal driving operation, the power save signal PS is inactive (low). Therefore, the P-channel MOS transistors 7 and 25 and the N-channel MOS transistor 9 are off, while the N-channel MOS transistors 4 and 28 are on. Also, the N-channel MOS transistor 10 is in off state since the fast restoration signal RT output from the comparator 23 is inactive (low). In similar fashion, the P-channel MOS transistor 12 is in off state due to the active (high) state of the fast restoration signal NRT generated by the inversion of the fast restoration signal RT through the comparator 23.

In the process, the P-channel MOS transistor 2, the resistor 3 and the N-channel MOS transistor 4 collaborate to generate a bias potential VIASP. In a similar manner, the P-channel MOS transistor 5 and the N-channel MOS transistor 6 collaborate to generate a bias potential VIASN. The bias potentials VIASP and VIASN are supplied to the amplifiers 31(1) to **31(*n*)** for driving the liquid crystal.

Next, with the arrival of the timing of transfer from the operation mode to the power save mode, the power save signal PS turns active (high). Then, the P-channel MOS transistors 7 and 25 and the N-channel MOS transistor 9 turn on, while the N-channel MOS transistors 4 and 28 turn off. As a result, the bias potential VIASP and the reference potential VBP turn high, the P-channel MOS transistor 5 turns off, and the bias potential VIASN turns low (standby potential). The bias potential VIASP at high level and the bias potential VIASN at low level are standby potentials. In this way, the bias potentials VIASP and VIASN transfer to the standby potential level, and therefore the steady current in the bias potential generating apparatus 22 becomes zero, so that the bias potential generating circuit 22 enters the power save mode.

At the next timing of transfer from the power save mode to the operation mode, the power save signal PS turns to inactive (low) state. Then, the P-channel MOS transistors 7 and 25 and the N-channel MOS transistor 9 turn off, while the N-channel MOS transistors 4 and 28 turn on. As a result, the P-channel MOS transistor 26, the resistor 27 and the N-channel MOS transistor 28 collaborate to restore the reference potential VBP to a predetermined bias potential level.

At the same time, the P-channel MOS transistor 2, the resistor 3 and the N-channel MOS transistor 4 collaborate to cause the tendency of the bias potential VIASP to return to a predetermined bias potential level. When the bias potential VIASP returns to a predetermined bias potential level, however, the input capacitances of the amplifiers 31(1) to **31(*n*) and the wiring capacitances 32(1) to 32(*n*)** are required to be discharged through a process taking a considerably long time. Therefore, considerable time would be required for the successful restoration of the potential VIASP to a predetermined bias potential level unless effective measures are taken.

In view of this, the comparator 23 detects that the bias potential VIASP is larger than the reference potential VBP, and turns the fast restoration signal RT to active (high) state. The fast restoration signal RT thus turned to active state is applied to the gate potential for the N-channel MOS transistor 10 thereby to turn on the transistor 10. As a result, the bias potential VIASP is pulled toward the ground, and thus restored quickly to a predetermined potential level.

At the same time, an inactive (low) fast restoration signal NRT is generated by the inversion of the active (high) fast restoration signal RT through the inverter 13.

The inactive fast restoration signal NRT thus generated is applied to the gate potential for the P-channel MOS transistor 12, which is kept on for a predetermined length of time. As a result, the bias potential VIASN is pulled toward the power supply and thereby restored to a predetermined bias potential level quickly.

The comparator 23 detects that the bias potential VIASP has been restored quickly to a predetermined bias potential level not larger than the reference potential VBP. Then, the fast restoration signal RT is turned to inactive (low) state. The fast restoration signal RT thus turned to inactive state is applied to the gate potential for the N-channel MOS transistor 10, which is thereby turned off.

On the other hand, the fast restoration signal RT which has been turned to inactive (low) state by the comparator 23 is inverted by the inverter 13, so that the fast restoration signal NRT is turned to active (high) state. The fast restoration signal NRT thus turned to active state is applied to the gate potential for the N-channel MOS transistor 12 thereby to turn off the transistor 10. As a result, one session of the fast restoring operation is completed.

According to this embodiment, the P-channel MOS transistor 12 and the N-channel MOS transistor 10 make up a potential restoration circuit, the reference potential generating circuit 24 generates a reference potential, and the comparator 23 makes up a drive control circuit.

According to this embodiment, after a reference potential is generated, the bias potential VIASP generated is compared with the reference potential to control the drive time of the potential restoration circuit including the P-channel MOS transistor 12 and the N-channel MOS transistor 10. Therefore, even in the case where a source voltage change or a temperature change occurs, all the bias potentials can be quickly restored to a just level.

The N-channel MOS transistor 10 and the P-channel MOS transistor 12 according to this embodiment may be replaced, with equal effect, by a CMOS transfer gate including a N-channel MOS transistor and a P-channel MOS transistor connected in parallel to each other.

(Fifth Preferred Embodiment)

Figure 7:
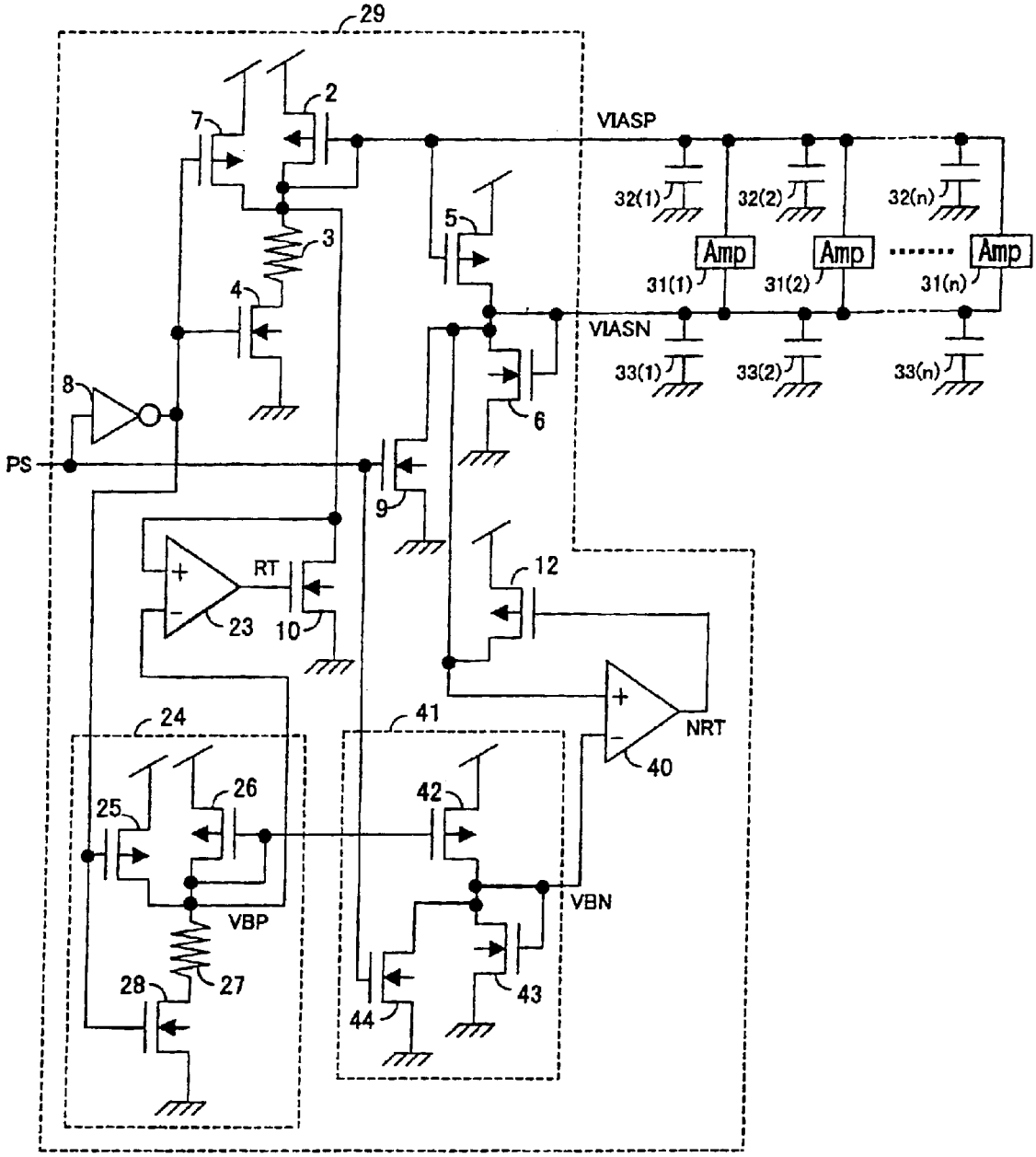
FIG. 7 is a circuit diagram showing a configuration of a bias potential generating apparatus according to a fifth preferred embodiment of the invention.

FIG. 7 is a circuit diagram showing a liquid crystal driving apparatus including a bias potential generating apparatus according to a fifth preferred embodiment of the invention. According to this embodiment, the invention is explained with reference to a liquid crystal driving apparatus comprising a drive output unit having n liquid crystal drive outputs combined with the bias potential generating apparatus, as an example.

In FIG. 7, numeral 29 designates a bias potential generating apparatus. The bias potential generating apparatus 29 includes P-channel MOS transistors 2, 5, 7 and 12, N-channel MOS transistors 4, 6, 9 and 10, a resistor 3, an inverter 8, comparators 23 and 40 and reference potential generating circuits 24 and 41. The bias potential generating apparatus 29 outputs a bias potential VIASP making up the gate potential for the P-channel MOS transistor of a constant current source and a bias potential VIASN making up the gate potential for the N-channel MOS transistor of a constant current source in the liquid crystal driving amplifiers 31(1) to **31(*n*). Numerals 32(1) to 32(*n*) and 33(1) to 33(*n*)** designate the wiring capacitances.

The reference potential generating circuit 24 includes P-channel MOS transistors 25 and 26, an N-channel MOS transistor 28 and a resistor 27. The reference potential generating circuit 24 generates a reference potential VBP not smaller than the bias potential VIASP in steady operation mode.

The reference potential generating circuit 41 includes a P-channel MOS transistor 42 and N-channel MOS transistors 43 and 44. The reference potential generating circuit 41 generates a reference potential VBN not higher than the bias potential VIASN in steady operation mode.

The comparator 23 compares the positive input potential with the negative input potential. The comparator 23 turns on the N-channel MOS transistor 10 in the case where the positive input potential is higher than the negative input potential, and turns off the N-channel MOS transistor 10 in the case where the positive input potential is equal to or lower than the negative input potential.

The comparator 40 compares the positive input potential with the negative input potential. The comparator 40 turns on the P-channel MOS transistor 12 in the case where the positive input potential is lower than the negative input potential, and turns off the P-channel MOS transistor 12 in the case where the positive input potential is equal to or higher than the negative input potential.

Next, the operation of restoring the bias potential generating apparatus 29 having the aforementioned configuration from the power save mode is explained.

First, during the liquid crystal driving operation, the power save signal PS is inactive (low). Therefore, the P-channel MOS transistors 7 and 25 and the N-channel MOS transistors 9 and 44 are off, while the N-channel MOS transistors 4 and 28 are on. Also, the N-channel MOS transistor 10 is in off state since the fast restoration signal RT output from the comparator 23 is inactive (low). In similar fashion, the P-channel MOS transistor 12 is in off state due to the inactive (low) state of the fast restoration signal NRT output by the comparator 40.

In the process, the P-channel MOS transistor 2, the resistor 3 and the N-channel MOS transistor 4 collaborate to generate a bias potential VIASP. In a similar manner, the P-channel MOS transistor 5 and the N-channel MOS transistor 6 collaborate to generate a bias potential VIASN. The bias potentials VIASP and VIASN are supplied to the amplifiers 31(1) to **31(*n*)** for driving the liquid crystal.

Next, with the arrival of the timing of transfer from the operation mode to the power save mode, the power save signal PS turns active (high). Then, the P-channel MOS transistors 7 and 25 and the N-channel MOS transistors 9 and 44 turn on, while the N-channel MOS transistors 4 and 28 turn off. As a result, the bias potential VIASP and the reference potential VBP turn high, the P-channel MOS transistors 5 and 42 turn off, and the bias potential VIASN and the reference potential VBN turn low. The bias potential VIASP at high level and the bias potential VIASN at low level are standby potentials. In this way, the bias potentials VIASP and VIASN transfer to the standby potential, and therefore the steady current in the bias potential generating apparatus 29 becomes zero so that the bias potential generating apparatus 29 enters the power save mode.

With the arrival of the next timing of transfer from the power save mode to the operation mode, the power save signal PS turns to inactive (low) state. Then, the P-channel MOS transistors 7 and 25 and the N-channel MOS transistors 9 and 44 turn off, while the N-channel MOS transistors 4 and 28 turn on. As a result, the P-channel MOS transistor 26, the resistor 27 and the N-channel MOS transistor 28 collaborate to restore the reference potential VBP to a predetermined bias potential level, while the P-channel MOS transistor 42 and the N-channel MOS transistor 43 collaborate to restore the reference potential VBN to a predetermined bias potential level.

At the same time, the P-channel MOS transistor 2, the resistor 3 and the N-channel MOS transistor 4 collaborate to cause the tendency of the bias potential VIASP to return to a predetermined bias potential. However, the input capacitances of the amplifiers 31(1) to **31(*n*) and the wiring capacitances 32(1) to 32(*n*)** are required to be discharged through a process consuming considerably long time. Therefore, considerable time would be required for the bias potential VIASP to be restored to a predetermined bias potential level unless effective measures are taken.

In view of this, the comparator 23 detects that bias potential VIASP is higher than the reference potential VBP, and turns the fast restoration signal RT to active (high) state. The fast restoration signal RT thus turned to active state is applied to the gate potential for the N-channel MOS transistor 10 thereby to turn on the transistor 10. As a result, the bias potential VIASP is pulled quickly toward the ground, and thus restored rapidly to a predetermined potential level.

Also, the comparator 23 detects that the bias potential VIASP has been restored quickly to a predetermined bias potential level not higher than the reference potential VBP. Then, the fast restoration signal RT is turned to inactive (low) state by the comparator 23. The fast restoration signal RT thus turned to inactive state is applied to the gate potential for the N-channel MOS transistor 10, which is thereby turned off.

At the same time, the comparator 40 detects that the bias potential VIASN is lower than the reference potential VBP, and turns the fast restoration signal NRT to inactive (low) state. The fast restoration signal NRT turned to inactive state is applied to the gate potential for the N-channel MOS transistor 12 thereby to turn on the transistor 12. As a result, the bias potential VIASN is pulled toward the power supply side quickly, and thus restored rapidly to a predetermined bias potential level.

The comparator 40 detects that the bias potential VIASN has been restored rapidly to a predetermined bias potential level not lower than the reference potential VBP. Then, the fast restoration signal NRT is turned to active (high) state by the comparator 40. The fast restoration signal NRT thus turned to active state is applied to the gate potential for the N-channel MOS transistor 12, which is thereby turned off.

According to this embodiment, the P-channel MOS transistor 12 and the N-channel MOS transistor 10 make up a potential restoration circuit, the reference potential generating circuits 24 and 41 each output a reference potential, and the comparators 23 and 40 make up a drive control circuit.

According to this embodiment, after a reference potential is generated, the bias potential VIASP generated is compared with the reference potential to control the drive time of the potential restoration circuit including the P-channel MOS transistor 12 and the N-channel MOS transistor 10. The reference potential generated undergoes no change with a temperature change or a source voltage change, if any. Therefore, regardless of a source voltage change or a temperature change, all the bias potentials can be quickly restored to a just level. Further, the reference potential generating circuits 24 and 41 and the comparators 23 and 40 are arranged for each of the bias potentials VIASN and VIASP, and each bias potential is compared with the reference potential. Therefore, the bias potential can be restored both with high accuracy and at high speed.

The N-channel MOS transistor 10 and the P-channel MOS transistor 12 according to this embodiment may be replaced, with equal effect, by a CMOS transfer gate including a N-channel MOS transistor and a P-channel MOS transistor connected in parallel to each other.

(Sixth Preferred Embodiment)

Figure 8:
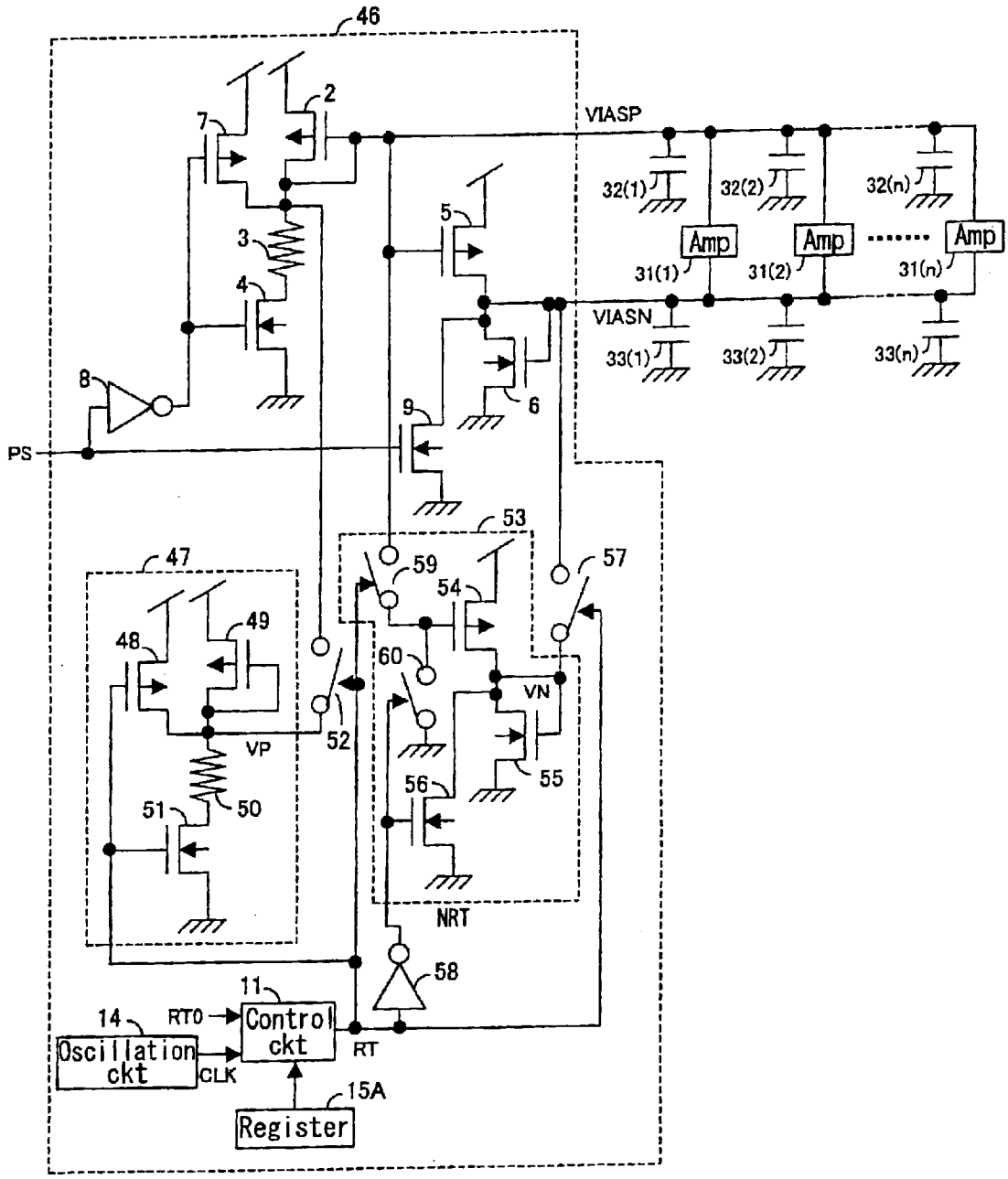
FIG. 8 is a circuit diagram showing a configuration of a bias potential generating apparatus according to a sixth preferred embodiment of the invention.

FIG. 8 is a circuit diagram showing a liquid crystal driving apparatus having built therein a bias potential generating apparatus according to a sixth preferred embodiment of the invention. According to this embodiment, the invention is explained with reference to a liquid crystal driving apparatus comprising a drive output unit having n liquid crystal drive outputs, combined with the bias potential generating apparatus, as an example.

In FIG. 8, numeral 46 designates a bias potential generating apparatus. The bias potential generating apparatus 46 includes P-channel MOS transistors 2, 5 and 7, N-channel MOS transistors 4, 6 and 9, a resistor 3, inverters 8 and 58, a control circuit 11, an oscillation circuit 14, a register 15A, switches 52 and 57 and restoration potential generating circuits 47 and 53. The bias potential generating apparatus 46 outputs a bias potential VIASP making up the gate potential for the P-channel MOS transistor of a constant current source and a bias potential VIASN making up the gate potential for the N-channel MOS transistor of a constant current source in liquid crystal driving amplifiers 31(1) to 31(*n*). Numerals 32(1) to 32(*n*) and 33(1) to 33(*n*) designate the wiring capacitances.

The restoration potential generating circuit 47 includes P-channel MOS transistors 48 and 49, an N-channel MOS transistor 51 and a resistor 50. The restoration potential generating circuit 47 generates a reference potential VP equal to the bias potential VIASP in steady operation mode.

The restoration potential generating circuit 53 includes a P-channel MOS transistor 54, N-channel MOS transistors 56 and 55 and switches 59 and 60. The restoration potential generating circuit 53 generates a reference potential VN equal to the bias potential VIASN in steady operation mode.

Next, the operation of restoring the bias potential generating apparatus 46 having the aforementioned configuration from the power save mode is explained.

First, during the liquid crystal driving operation, the power save signal PS is inactive (low). Therefore, the P-channel MOS transistor 7 and the N-channel MOS transistor 4 are off, while the N-channel MOS transistor 4 is on. Also, the switches 52 and 57 are off since the fast restoration signal RT output from the control circuit 11 is inactive (low).

In the process, the P-channel MOS transistor 2, the resistor 3 and the N-channel MOS transistor 4 collaborate to generate a bias potential VIASP. In similar manner, the P-channel MOS transistor 5 and the N-channel MOS transistor 6 collaborate to generate a bias potential VIASN. The bias potentials VIASP and VIASN are supplied to the amplifiers 31(1) to 31(*n*) for driving the liquid crystal.

In the restoration potential generating circuit 47, the fast restoration signal RT is inactive (low), and therefore the N-channel MOS transistor 51 is off, while the P-channel MOS transistor 48 is on. As a result, the restoration potential generating circuit 47 outputs a source potential as a restoration potential VP.

In the restoration potential generating circuit 53, the fast restoration signal RT is inactive (low), and therefore the switch 59 turns off. Also, in view of the fact that the fast restoration signal NRT turns active (high) due to the inverting operation of the inverter 58, the switch 60 turns on. Thus, the N-channel MOS transistor 56 turns on, while the P-channel MOS transistor 54 turns off. As a result, the restoration potential generating circuit 53 outputs the ground potential as a restoration potential VN.

Next, with the arrival of the timing of transfer from the operation mode to the power save mode, the power save signal PS turns active (high). Then, the P-channel MOS transistor 7 and the N-channel MOS transistor 9 turn on, while the N-channel MOS transistor 4 turns off. As a result, the bias potential VIASP turns high, the P-channel MOS transistor 5 turns off, and the bias potential VIASN potential turns low. In this way, the bias potentials VIASP and VIASN transfer to the standby potential level, and therefore the steady current in the bias potential generating apparatus 46 becomes zero, so that the bias potential generating apparatus 46 enters the power save mode.

At the next timing of transfer from the power save mode to the operation mode, the power save signal PS turns to inactive (low) state. Then, the P-channel MOS transistor 7 and the N-channel MOS transistor 9 turn off, while the N-channel MOS transistor 4 turns on. As a result, the P-channel MOS transistor 2, the resistor 3 and the N-channel MOS transistor 4 collaborate to cause the tendency of the bias potential VIASP to return to a predetermined bias potential level. However, when the bias potential VIASP returns to a predetermined bias potential level, the input capacitances of the amplifiers 31(1) to 31(*n*) and the wiring capacitances 32(1) to 32(*n*) are required to be discharged through a process consuming a considerable length of time. Therefore, unless some appropriate means is taken, a considerable length of time is taken before the bias potential VIASP is restored to a predetermined bias potential level.

In view of this, the control circuit 11 turns the fast restoration signal RT in pulse waveform to active (high) state based on the clock input CLK supplied from the oscillation circuit 14 and the original fast restoration signal RTO. The control circuit 11 sets the pulse width (active period) of the fast restoration signal RT in accordance with the set value of the register 15A. Therefore, by changing the set value of the register 15A, the pulse width (active period) of the fast restoration signal RT can be set arbitrarily.

The fast restoration signal RT that has been turned to active state is applied to the gate potential of the P-channel MOS transistor 48 and the N-channel MOS transistor 51. Thus, the transistor 48 turns off and the transistor 51 turns on. Further, the active fast restoration signal RT is supplied to and turns on the switches 59, 52 and 57.

Further, the fast restoration signal NRT that has been turned to inactive (low) state by the inverting process of the inverter 58 is applied to the gate potential of the N-channel MOS transistor 56 and the switch 60, thereby turning off the transistor 56 and the switch 60. As a result, the restoration potential generating circuits 47 and 53 generate restoration potentials VP and VN.

In the process, the switches 52 and 57 are turned on for a predetermined length of time by the fast restoration signal RT. Thus, the bias potential VIASP is pulled toward the restoration potential VP, and therefore restored quickly to a predetermined bias potential level. In a similar fashion, the bias potential VIASN, which is pulled toward the restoration potential VN, is rapidly restored to a predetermined bias potential level.

In this embodiment, the restoration potential generating circuits 47 and 53 make up a restoration potential generating circuit in the broad sense of the word. The switches 52 and 57 make up a potential restoration circuit. The register 15A makes up a drive time setting circuit. The oscillation circuit 14, the control circuit 11 and the inverter 58 make up a drive control circuit.

According to this embodiment, the bias potential VIASP is restored to a predetermined bias potential level by the operation of the restoration potential generating circuit 47 and the switch 52, while the bias potential VIASN is restored to a predetermined bias potential level by the operation of the restoration potential generating circuit 53 and the switch 57. In this way, the provision of a restoring configuration corresponding to each bias potential shortens the time required for restoration.

The bias potential generating apparatus 46 can change the pulse width of the fast restoration signal RT in accordance with the set value of the register 15A. Therefore, by changing the set value of the register 15A in accordance with the change in conditions such as a source voltage, an optimum pulse width can be selected. As a result, the on time of the switches 52 and 57 required to restore the bias potentials VIASP and VIASN quickly can be set in accordance with a change, if any, of the temperature or the source voltage. Therefore, even in the case where the source voltage or the temperature undergoes a change, the bias potentials VIASP and VIASN can be quickly restored to a just level.

In this embodiment, each of the switches 52, 57, 59 and 60 is generally configured of a CMOS transfer gate including a N-channel MOS transistor and a P-channel MOS transistor connected in parallel to each other. Nevertheless, an alternative configuration having similar functions can produce a similar effect.

The most preferred embodiments of the invention are described above. The combination and arrangement of the circuit components in these preferred embodiments can be variously modified without departing from the spirit and scope of the invention described in the claims appended hereto.

What is claimed is:

1. A bias potential generating apparatus for generating a standby potential in a power save mode and a bias potential in an operation mode, and for selectively outputting the standby potential or the bias potential to an output node, comprising:

a bias potential outputting circuit for preliminarily determining a level of the bias potential and for being capable of outputting the bias potential to the output node;

a standby potential outputting circuit for preliminarily determining a level of the standby potential and for being capable of outputting the standby potential to the output node;

a potential restoration circuit for outputting a potential having a level different from that of the standby potential to the output node for a predetermined time period at the timing of transfer from power save mode to operation mode; and a drive control circuit connected to the potential restoration circuit and capable of changing the predetermined time period.

2. A bias potential generating apparatus according to claim 1, wherein the drive control circuit controls the drive operation of the potential restoration circuit based on a pulse waveform signal, the drive control circuit including an oscillation circuit for generating a clock signal for generating the pulse waveform signal.

3. A bias potential generating apparatus according to claim 1, further comprising:

a drive time setting circuit for setting the drive time of the potential restoration circuit arbitrarily.

4. A bias potential generating apparatus according to claim 3, wherein the drive control circuit controls the drive operation of the potential restoration circuit based on a pulse waveform signal; and wherein the drive time setting circuit is a register for outputting a set value equal to the pulse width of the pulse waveform signal.

5. A bias potential generating apparatus according to claim 1, further comprising: a current setting circuit for arbitrarily setting a restoration current used in the potential restoration circuit at the time of restoring the bias potential.

6. A bias potential generating apparatus according to claim 5, wherein the potential restoration circuit is constituted by a plurality of MOS transistors connected in parallel to each other for generating the restoration current; and wherein the current setting circuit supplies a conduction control signal individually to each of the plurality of the MOS transistors.

7. A bias potential generating apparatus according to claim 1, wherein the potential restoration circuit includes a plurality of MOS transistors connected in series with each other for generating a threshold voltage by shorting the gate potential and the drain potential; and wherein the restoration voltage of the potential restoration circuit used for restoring the bias potential can be set arbitrarily by changing the number of the MOS transistors.

8. A bias potential generating apparatus according to claim 1, further comprising:

a reference potential generating circuit for generating a reference potential having a potential equivalent to the bias potential;

wherein the drive control circuit drives the potential restoration circuit during the period when the generated potential fails to reach the reference potential, and stops driving the potential restoration circuit at the time point when the generated potential reaches the reference potential.

9. A bias potential generating apparatus according to claim 1, further comprising:

a restoration potential generating circuit for generating a restoration potential equivalent to the bias potential;

wherein the potential restoration circuit shorts the generated potential to the restoration potential at the time of restoring the potential.

10. A bias potential generating apparatus according to claim 1, wherein the potential restoration circuit includes a plurality of MOS transistors connected in series with each other for generating a threshold voltage by shorting the gate potential and the drain potential.

11. A bias potential generating apparatus for generating a potential by switching between a bias potential and a standby potential, comprising:

a potential restoration circuit for restoring the generated potential from the standby potential to the bias potential; and a drive control circuit for controlling the drive operation of the potential restoration circuit;

wherein the potential restoration circuit includes a plurality of MOS transistors connected in series with each other for generating a threshold voltage by shorting the gate potential and the drain potential; and wherein the restoration voltage used for restoring the bias potential can be arbitrarily set by changing the number of the MOS transistors of the potential restoration circuit.

* * * * *

UNITED STATES PATENT AND TRADEMARK OFFICE

CERTIFICATE OF CORRECTION

PATENT NO. : 6,930,543 B2
DATED : August 16, 2005
INVENTOR(S) : Kazuyoshi Nishi

It is certified that error appears in the above-identified patent and that said Letters Patent is hereby corrected as shown below:

Title page,
Item [30], Foreign Application Priority Data, change the date of "Apr. 10, 2002" to -- October 4, 2002 --.

Signed and Sealed this

Thirteenth Day of December, 2005

JON W. DUDAS
*Director of the United States Patent and Trademark Office*